US006263849B1

(12) United States Patent
Bonesteel et al.

(10) Patent No.: US 6,263,849 B1
(45) Date of Patent: Jul. 24, 2001

(54) ULTRA LIGHT ENGINE VALVE AND METHOD OF WELDING CAP THERETO

(75) Inventors: David L. Bonesteel, Richland; Leslie L. Ecklund, Battle Creek; Michael J. Froehlich, Bellevue; Michael L. Killian, Troy; Philip M. Kline, Tekonsha, all of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/356,989

(22) Filed: Jul. 20, 1999

(51) Int. Cl.[7] ..... F01L 1/14

(52) U.S. Cl. ..... 123/90.51; 123/188.2; 123/188.3

(58) Field of Search ..... 123/90.51, 188.2, 123/188.3; 29/888.4, 888.44, 888.45

(56) References Cited

U.S. PATENT DOCUMENTS

| | | | | |
|---|---|---|---|---|
| 2,070,102 | * | 2/1937 | Weslake | 29/888.45 |
| 4,169,488 | * | 10/1979 | Goloff et al. | 123/188.3 |
| 4,362,134 | * | 12/1982 | Worthen | 123/188.3 |
| 4,928,645 | * | 5/1990 | Berneburg et al. | 123/188.3 |
| 5,054,195 | | 10/1991 | Keck et al. | 29/888.453 |
| 5,056,219 | * | 10/1991 | Iwase | 123/188.3 |
| 5,094,200 | * | 3/1992 | Fontichiaro | 123/188.2 |
| 5,413,073 | | 5/1995 | Larson et al. | 123/188.3 |
| 5,458,314 | * | 10/1995 | Bonesteel | 29/888.45 |
| 5,771,852 | * | 6/1998 | Heimann, Jr. et al. | 123/188.3 |
| 5,823,158 | * | 10/1998 | Heimann, Jr. et al. | 123/188.3 |
| 6,006,713 | * | 12/1999 | Gebauer | 123/188.3 |

FOREIGN PATENT DOCUMENTS 683057 11/1952 (GB) .

* cited by examiner

*Primary Examiner*—Teresa Walberg
*Assistant Examiner*—Fadi Dahbour
(74) *Attorney, Agent, or Firm*—L. J. Kasper

(57) ABSTRACT

A hollow poppet valve (31) is disclosed, in which a stem portion (13) includes a flared fillet portion (17), having a wall thickness (T), and a downwardly-extending cylindrical portion (33;51), having a cylindrical external surface (35). In the main embodiment, the valve includes a cap member (15) defining a seat face (25), and a cylindrical internal surface (39), the internal and external surfaces (39,35) being closely spaced apart, defining an interface having an axial length (L), and being consumed by a weld (43). Preferably, the length (L) of the weld (43) is equal to at least 1.1 times the thickness (T). The fillet portion (17) defines an internal fillet radius (R1), greater than 0.3 times the thickness (T), and near the radius (R1) is a transition region (TR). The present invention improves fatigue strength of the poppet valve by separating the transition region (TR) from the weld (43) so that there is overlap for no more than a minor portion of the weld.

8 Claims, 2 Drawing Sheets

ULTRA LIGHT ENGINE VALVE AND METHOD OF WELDING CAP THERETO

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates generally to poppet valves for internal combustion engines, and more particularly, to a hollow poppet valve which is able to maintain a very high strength-to-weight characteristic. Although the present invention is adapted for use with many different types of hollow poppet valves, it is especially advantageous when used with an ultra light poppet valve, and will be described in connection therewith.

Internal combustion engine poppet valves have been commonly fabricated by machining, forging, or extruding a solid blank of high-strength, heat resistant metal, and then subjecting the blank to various finish machining and/or grinding operations. In some applications, performance requirements have made it necessary to provide a valve having a hollow stem into which a coolant, such as a sodium-potassium mixture, may be added during the fabrication process. Prior to the early 1990s, such hollow stems were formed by means such as drilling or extruding, or by forging the stem over a mandrel or a removable core, or by cold forming a tubular blank to a desired stem diameter, then shaping the fillet portion and then attaching separate cap and tip members.

A true ultra light engine poppet valve was first illustrated and described in U.S. Pat. No. 5,413,073, assigned to the assignee of the present invention and incorporated herein by reference. In the incorporated patent, the poppet valve comprises a stem element which includes an integral tip portion and a fillet portion, and a cap member which is welded to the fillet portion. Preferably, the stem including the fillet portion is fabricated by means of a deep drawing process wherein a starting blank in the form of a sheet-like disk is subjected to a plurality of cold drawing steps. The wall thickness of the stem, after the deep drawing is completed, is substantially less than that of the fillet portion or the tip portion. These steps result in an elongated flared cup wherein the outer edge of the flared fillet portion is substantially the thickness of the starting blank.

In the above-described ultra light poppet valve structure, the flared fillet region terminates in a generally radially extending edge or rim, which is received against a shoulder defined by a depression formed in the cap. The depth of the depression is approximately equal to the thickness of the fillet region. The cap is then welded to the outer edge of the flared fillet portion. Depending upon the configuration of the particular valve, the seat face of the poppet valve may be defined by either the fillet portion, or the cap member, or both.

Although the above-described poppet valve structure has proven itself to be generally satisfactory as far as fabrication and performance within the engine, it has become apparent that there are various engine applications which require an overall strength, and especially a fatigue strength, which is greater than can readily be accomplished by the above-described known and conventional method of joining the cap member to the fillet portion.

BRIEF SUMMARY OF THE INVENTION

Accordingly, it is an object of the present invention to provide an improved hollow poppet valve having substantially improved fatigue strength and durability in the region of the weld of the fillet and cap member.

It is a related object of the present invention to provide an improved ultra light poppet valve which accomplishes the above-stated object and which is configured to substantially reduce the occurrence of stress concentration, resulting from a combination of the configuration and location of the weld joint between the cap member and the fillet portion.

The above and other objects of the invention are accomplished by the provision of a hollow poppet valve for use in an internal combustion engine, the poppet valve comprising a stem portion, a tip portion, a cap portion, and a flared fillet portion defining a transition region between the stem portion and the cap portion. The flared fillet portion has a wall thickness and a downwardly extending, generally cylindrical portion defining an inside fillet radius. One of the cylindrical portion and the cap portion defines a seat face adapted for sealing engagement with a valve seat. One of the cylindrical portion and the cap portion define a generally cylindrical internal surface and the other of the cylindrical portion and the cap portion define a generally cylindrical external surface, the internal and external surfaces being generally concentric and closely spaced apart.

The improved hollow poppet valve is characterized by the inside fillet radius being greater than about 0.3 times the wall thickness of the fillet portion. A weld consumes substantially the entire axial extent of the interface of the internal and external surfaces. The generally cylindrical portion and the cap portion cooperate to define an annular, horizontal interface disposed immediately radially inward from the interface of the internal and external surfaces.

DETAILED DESCRIPTION OF THE PREFERRED EMBODIMENT

Figure 1:
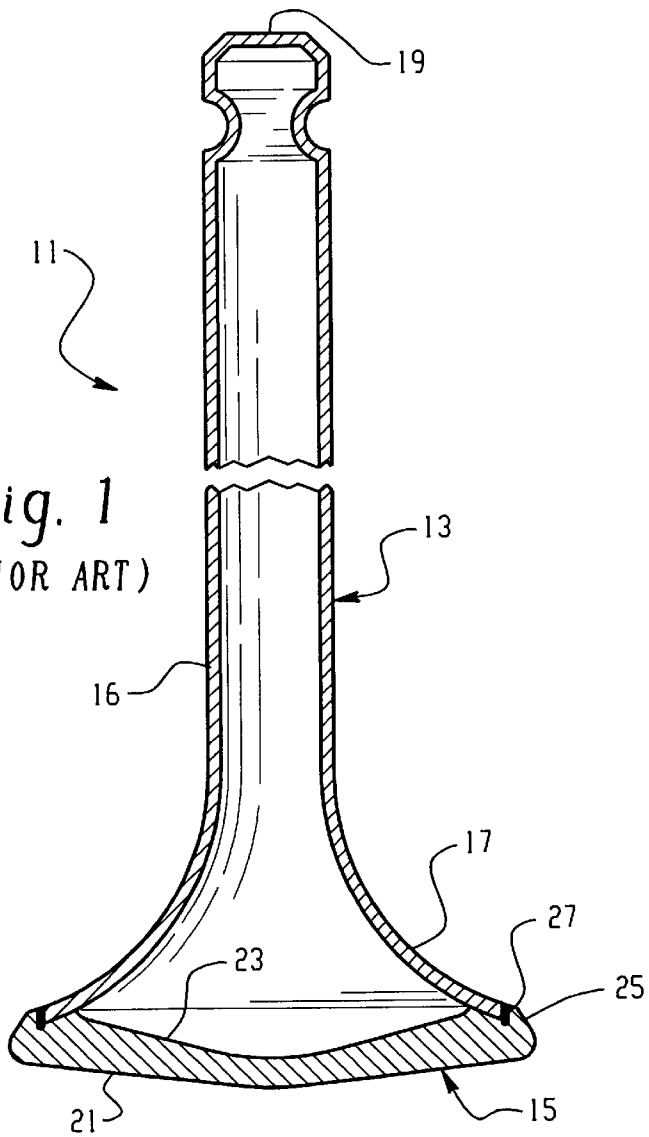
Fig. 1 (PRIOR ART)
FIG. 1 is a partly broken away, axial cross-section of a prior art hollow poppet valve.

Referring now to the drawings, which are not intended to limit the invention, FIG. 1 illustrates an engine poppet valve, generally designated 11, for use in an internal combustion engine. The poppet valve 11 is of the type disclosed in above-incorporated U.S. Pat. No. 5,413,073. The poppet valve 11 comprises a stem element, generally designated 13, and a cap member 15 welded to the stem element 13. In a preferred embodiment, the stem element 13 for an intake valve may be fabricated using a ductile metal sheet product such as SAE 1008 steel, while the stem element for an exhaust valve may be fabricated using a stainless steel such as an austenitic grade. Typically, the cap member 15 is formed of a stainless steel or other compatible material, whether the poppet valve is being used as an intake valve or as an exhaust valve. Those skilled in the art will understand that specific materials will vary depending upon the particular engine application, and except as hereinafter noted, the present invention is not limited to any particular materials.

As is now well known in the art from the above-incorporated patent, the stem element 13 is formed by a deep drawing process which results in a structure having a very thin stem wall 16 and being hollow from a flared fillet portion 17 all the way to a tip portion 19. However, those skilled in the art will understand that the invention is not so limited. Referring still to FIG. 1, the cap member 15 is a disk which is preferably formed with a convex combustion face 21 and a concave internal face 23. In the "PRIOR ART" poppet valve 11 of FIG. 1, the cap member 15 defines a seat face 25, which may be formed by machining, or deposition and machining, or by any other known method. It should also be noted that in the "PRIOR ART" poppet valve 11 of FIG. 1, the flared fillet portion 17 terminates in a radially extending edge which is joined at a recess in the cap member 15 by means of a weld 27.

Figure 2:
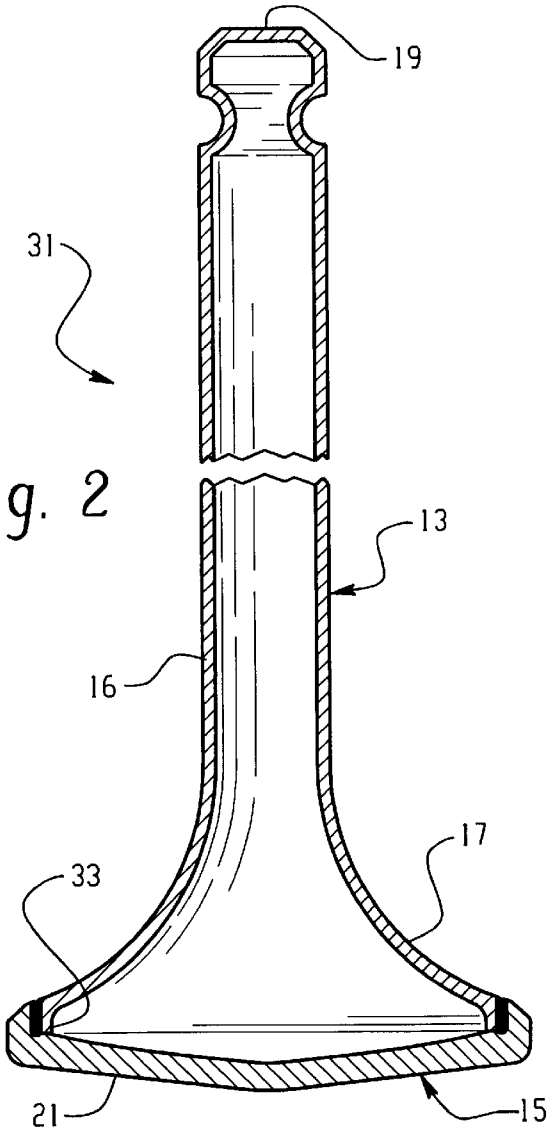
FIG. 2 is a view similar to FIG. 1, illustrating an ultra light poppet valve made in accordance with the present invention.

Referring now primarily to FIG. 2, there is a drawing similar in nature to FIG. 1, but illustrating the present invention, in which like elements bear like numerals, but new or substantially modified elements bear reference numerals in excess of "30". Therefore, the present invention is a poppet valve 31 including the stem element 13 and the cap member 15 welded to the stem element 13. As in the prior art poppet valve, the stem element 13 includes a very thin stem wall 16, a flared fillet portion 17 and a tip portion 19. It will be understood by those skilled in the art that the tip portion 19 shown herein is by way of example only, is not an essential feature of the invention, and various other tip configurations could be utilized without departing from the present invention, including the insertion of a separate tip member. By way of example only, the tip portion 19 could utilize any of the tip configurations shown in co-pending application U.S. Ser. No. 08/955,188, filed Oct. 21, 1997 in the name of David L. Bonesteel, for "IMPROVED TIP STRUCTURES FOR AN ULTRA LIGHT ENGINE VALVE".

Figure 3:
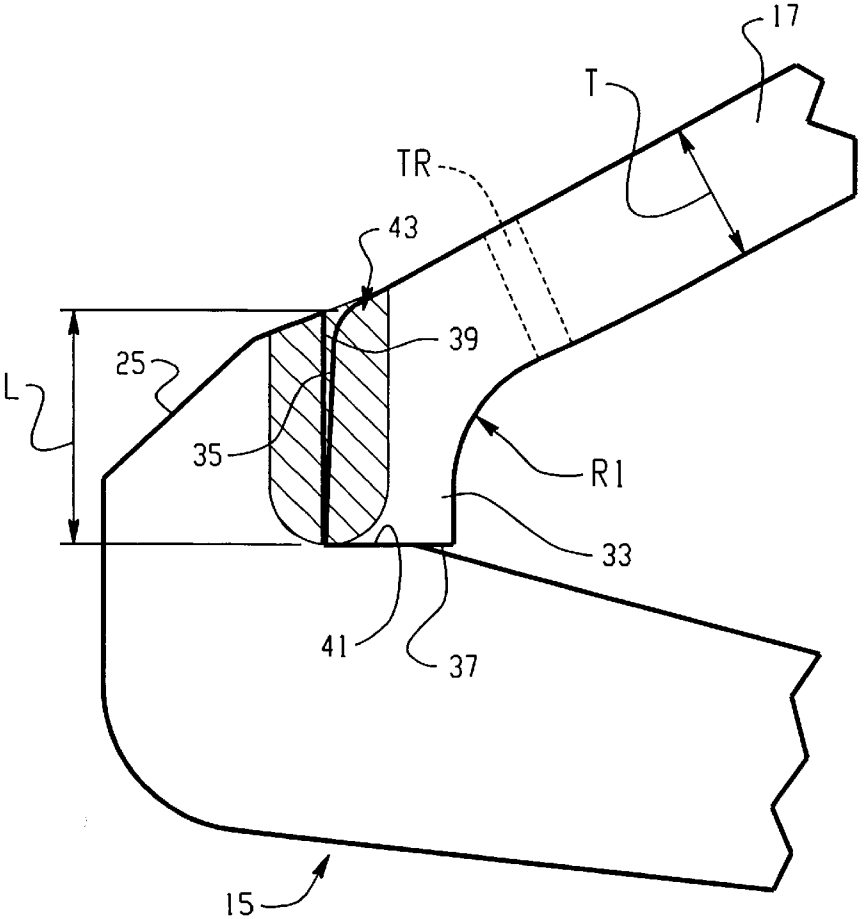
FIG. 3 is a greatly enlarged, fragmentary axial cross-section illustrating the present invention in greater detail.

In accordance with one important aspect of the invention, the flared fillet portion 17 does not terminate in a radially extending edge, but instead, terminates in a downwardly-extending, generally cylindrical portion 33, shown in greater detail in FIG. 3. The cylindrical portion 33 is joined to the cap member 15 by means of a novel attachment configuration, to be described hereinafter. Referring now primarily to FIG. 3, in conjunction with FIG. 1, the flared fillet portion 17 has a wall thickness T which, as is now well known to those skilled in the art, would typically be approximately equal to the thickness of the ductile metal sheet which comprise the starting material for the deep drawing process. As is also now well known, the wall thickness T would be substantially greater than the wall thickness of the majority of the length of the thin stem wall 16, between the fillet portion 17 and the tip portion 19. Typically, and by way of example only, the wall thickness of the stem after the deep drawing process, would be in the range of about 0.5 T.

The downwardly-extending, generally cylindrical portion 33 defines an inside fillet radius R1, the significance of this radius to be described in greater detail subsequently. The cylindrical portion 33 also defines a generally cylindrical, external surface 35 and a terminal or bottom horizontal surface 37.

The cap member 15 in the FIG. 3 embodiment defines the seat face 25, but also defines a generally cylindrical internal surface 39 and a horizontal surface 41, disposed immediately radially inward from the internal surface 39. It will be understood by those skilled in the art that the use of terms such as "downwardly" and "horizontal" herein is used, not by way of limitation, but merely by way of description and example, assuming that the poppet valve 31 is in the orientation shown in FIG. 2.

When the cylindrical portion 33 is received within the cap member 15, and positioned for welding, the internal and external surfaces 35 and 39, respectively, are closely spaced apart from each other, and the horizontal surfaces 37 and 41 are preferably in engagement to define an annular horizontal interface, also bearing the reference numerals "37,41". In accordance with the present invention, the horizontal interface 37, 41 is disposed immediately radially inward from the interface of the internal surface 35 and the external surface 39.

Once the cylindrical portion 33 is in place as shown in FIG. 3, the next step is to weld the interface of the portion 33 and the cap member 15, the weld being generally designated 43, and the extent of the weld 43, both radially and axially, being indicated somewhat schematically by the cross-hatched area in FIG. 3. Although, within the scope of the present invention, various types of weld could be utilized, the development of the subject embodiment has indicated that some form of laser beam welding process (such as YAG laser beam welding) is greatly preferred.

The present invention results in an improved structure in several different ways, which will now be described. In connection with the development of the present invention, it has been determined that it is desirable to relocate the weld joint stress concentration to an area where the operating loads are spread out over a larger cross section, in order to increase the fatigue strength of the poppet valve. To help insure the fatigue strength of the weld 43, and thus the fatigue strength of the poppet valve in operation, it is preferable that the axial length L of the weld 43 be equal to at least about 1.1 times the wall thickness T. It is recognized that the lower portion of the weld 43 (or the horizontal interface 37,41) is a form of stress concentrator, similar to that of the prior art. However, the stated relationship of L and T helps insure that this stress concentrator is relocated to an area where the operating loads are spread over a larger cross sectional area.

It has also been determined that the inside fillet radius R1 must be kept relatively large in order to minimize stress concentration, and in the subject embodiment, it has been found preferable for the inside fillet radius R1 to be greater than 0.3 times the wall thickness T of the flared fillet portion 17, thereby minimizing what would otherwise be a very high stress area, if the inside fillet radius were smaller than 0.3 times T.

As is shown in FIG. 3, there is a transition region TR which represents a transition from the relatively thin section of the fillet portion 17 to the relatively thick section to the left (in FIG. 3) of the transition region TR. As is well known to those skilled in the art, this transition region TR is typically where cracks would propagate, taking the shortest available path. Therefore, in accordance with one important aspect of the invention, the region of the weld 43 is almost entirely separate from the transition region TR, or stated alternatively, the weld 43 and the transition region TR overlap for no more than a minor portion of the weld. By relocating the weld joint as shown, the "weld heat affected zone" surrounding the weld 43, which is an area of relative weakness in a welded part, has relatively little overlap with the transition region TR, and does not extend to the inside fillet radius R1. Stated another way, the configuration of the present invention results in a homogeneous base material across the transition region TR, rather than having that region weakened by the weld or by the weld heat affected zone.

Figure 4:
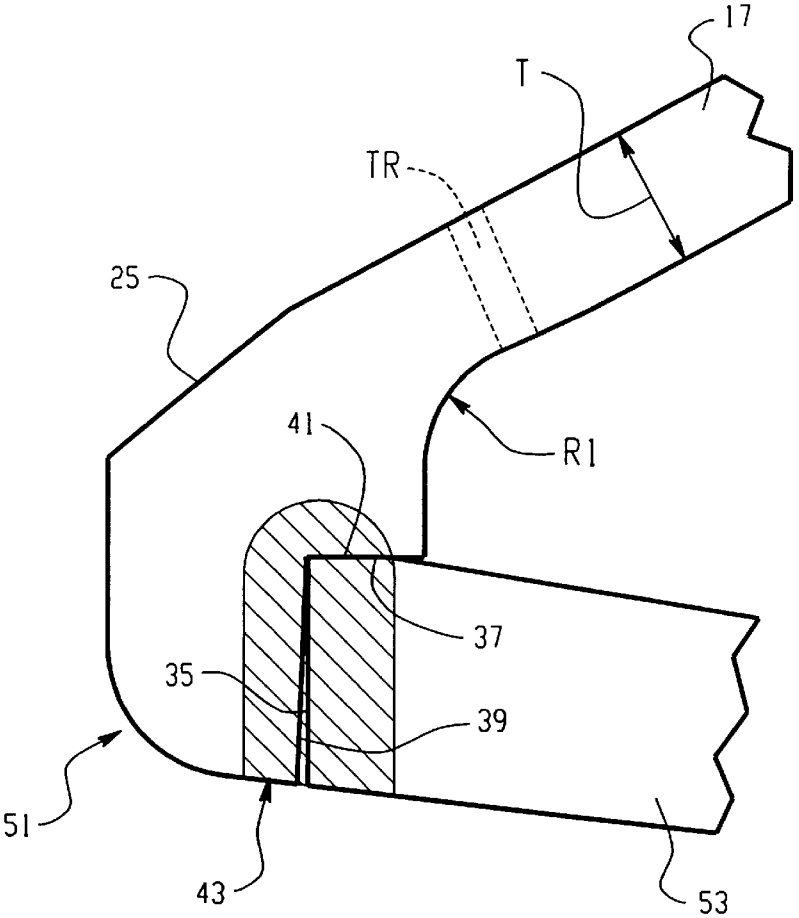
FIG. 4 is a view similar to FIG. 3, illustrating an alternative embodiment of the present invention.

Referring now primarily to FIG. 4, there is illustrated an alternative embodiment of the invention. In the FIG. 4 embodiment, like elements bear like numerals, and new or substantially modified elements bear reference numerals in excess of "50".

Therefore, in FIG. 4, the flared fillet portion 17 terminates in an annular portion 51 which defines the seat face 25, and also defines the generally cylindrical, internal surface 39. The annular portion 51 defines the inside fillet radius R1, which is again preferably greater than 0.3 times the wall thickness T of the fillet portion 17, and for the same reasons as described in connection with the main embodiment. The poppet valve of FIG. 4 includes a cap member 53 which defines the generally cylindrical, external surface 35, also closely spaced apart relative to the internal surface 39. The annular portion 51 and the cap member 53 define horizontal surfaces 37 and 41, respectively, which define the horizontal interface, in the same general manner as in the FIG. 3 embodiment. The description of the weld 43 provided in regard to the FIG.3 embodiment is equally applicable to the embodiment of FIG. 4, both in terms of the axial length L of the weld 43, and in terms of the weld 43 being separated from the transition region TR, which is even more pronounced in the FIG. 4 embodiment.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hollow poppet valve for use in an internal combustion engine, said poppet valve comprising a stem portion, a tip portion, a cap portion, and a flared fillet portion defining a transition region between said stem portion and said cap portion; said flared fillet portion having a wall thickness, and a downwardly-extending, generally cylindrical portion defining an inside fillet radius; one of said generally cylindrical portion and said cap portion defining a seat face, adapted for sealing engagement with a valve seat; one of said generally cylindrical portion and said cap portion defining a generally cylindrical, internal surface, and the other of said generally cylindrical portion and said cap portion defining a generally cylindrical, external surface, said internal and external surfaces being generally concentric and closely spaced apart; characterized by:

(a) said inside fillet radius being greater than about 0.3 times said wall thickness;

(b) a weld consuming substantially the entire axial extent of the interface of said internal and external surfaces; and (c) said generally cylindrical portion and said cap portion cooperating to define an annular, horizontal interface disposed immediately radially inward from said interface of said internal and external surfaces.

2. A hollow poppet valve as claimed in claim 1, characterized by said valve comprising an ultra light poppet valve, said stem portion including a very thin stem wall.

3. A hollow poppet valve as claimed in claim 2, characterized by said stem portion and said fillet portion being defined by a one-piece, thin-walled cylindrical member, said stem portion having a wall thickness which is less than said wall thickness of said flared fillet portion.

4. A hollow poppet valve as claimed in claim 3, characterized by said stem portion has a stem wall, and the thickness of said stem wall is in the range of about one-half of said wall thickness of said flared fillet portion.

5. A hollow poppet valve as claimed in claim 1, characterized by said cap portion defining said seat face; said cap portion defining said internal surface; and said generally cylindrical portion defining said external surface.

6. A hollow poppet valve as claimed in claim 1, characterized by said generally cylindrical portion defining said seat face and said internal surface, and said cap portion defining said external surface.

7. A hollow poppet valve as claimed in claim 1, characterized by said axial extent of said weld is greater than about 1.1 times said wall thickness of said flared fillet portion.

8. A hollow poppet valve for use in an internal combustion engine, said poppet valve comprising a stem portion, a tip portion, a cap portion, and a flared fillet portion defining a transition region between said stem portion and said cap portion; said flared fillet portion having a wall thickness, and a downwardly-extending, generally cylindrical portion defining an inside fillet radius; one of said generally cylindrical portion and said cap portion defining a seat face, adapted for sealing engagement with a valve seat; one of said generally cylindrical portion and said cap portion defining a generally cylindrical, internal surface, and the other of said generally cylindrical portion and said cap portion defining a generally cylindrical, external surface, said internal and external surfaces being generally concentric and closely spaced apart; characterized by:

(a) said inside fillet radius being greater than about 0.3 times said wall thickness;

(b) a weld consuming substantially the entire axial extent of the interface of said external and internal surfaces; and (c) said flared fillet portion and said inside fillet radius cooperating to define a transition region, said weld and said transition region overlapping for no more than a minor portion of said weld.

* * * * *